US009514880B2

(12) United States Patent
Park et al.

(10) Patent No.: US 9,514,880 B2
(45) Date of Patent: Dec. 6, 2016

(54) COIL UNIT FOR THIN FILM INDUCTOR, MANUFACTURING METHOD OF COIL UNIT FOR THIN FILM INDUCTOR, THIN FILM INDUCTOR AND MANUFACTURING METHOD OF THIN FILM INDUCTOR

(71) Applicant: SAMSUNG ELECTRO-MECHANICS CO., LTD., Gyeonggi-Do (KR)

(72) Inventors: Jeong Woo Park, Suwon-si (KR); Seon Ha Kang, Suwon-si (KR); Oh Hi Lee, Busan (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 44 days.

(21) Appl. No.: 14/460,022

(22) Filed: Aug. 14, 2014

(65) Prior Publication Data

US 2015/0048918 A1 Feb. 19, 2015

(30) Foreign Application Priority Data

Aug. 14, 2013 (KR) ..... 10-2013-0096649

(51) Int. Cl.

| | |
|---|---|
| ***H01F 5/00*** | (2006.01) |
| ***H01F 27/28*** | (2006.01) |
| ***H01F 27/24*** | (2006.01) |
| ***H01F 27/02*** | (2006.01) |
| ***H01F 41/04*** | (2006.01) |
| ***H01F 17/00*** | (2006.01) |

(52) U.S. Cl.

CPC ..... *H01F 41/041* (2013.01); *H01F 17/0013* (2013.01); *H01F 41/046* (2013.01); *H01F 2017/0066* (2013.01); *Y10T 29/49071* (2015.01)

(58) Field of Classification Search

CPC ..... H01F 27/2804; H01F 41/041; H01F 2027/2809; H01F 17/0013

USPC ..... 336/200, 232, 234, 223, 83

See application file for complete search history.

(56) References Cited

U.S. PATENT DOCUMENTS

| | | | | |
|---|---|---|---|---|
| 6,515,568 | B1 * | 2/2003 | Maki | H01F 17/0013 336/200 |
| 7,759,776 | B2 * | 7/2010 | Cheng | G01R 1/07378 257/659 |
| 2003/0048167 | A1 * | 3/2003 | Inoue | H01F 17/0013 336/200 |
| 2004/0164835 | A1 * | 8/2004 | Shoji | H01F 17/0013 336/200 |
| 2006/0152321 | A1 * | 7/2006 | Jung | H01F 17/0006 336/200 |
| 2007/0285202 | A1 * | 12/2007 | Ito | H01F 17/0013 336/200 |
| 2010/0148905 | A1 * | 6/2010 | Matsumoto | H01F 41/041 336/137 |
| 2010/0157565 | A1 * | 6/2010 | Yoshida | H01F 27/292 361/811 |
| 2010/0245013 | A1 * | 9/2010 | Kawabata | H01F 17/0006 336/200 |
| 2011/0193671 | A1 * | 8/2011 | Iwasaki | H01F 17/0013 336/200 |

FOREIGN PATENT DOCUMENTS

KR 10-1999-0066108 A 8/1999

* cited by examiner

*Primary Examiner* — Elvin G Enad
*Assistant Examiner* — Kazi Hossain
(74) *Attorney, Agent, or Firm* — McDermott Will & Emery LLP

(57) ABSTRACT

Embodiments of the invention provide a coil unit for a thin film inductor, a manufacturing method of a coil unit for a thin film inductor, a thin film inductor, and a manufacturing method of a thin film inductor. According to an embodiment, there is provided a coil unit for a thin film inductor. The coil unit includes an insulator having a dual insulating layer of different materials, and coil patterns respectively embedded in upper and lower surfaces of the insulator. The coil patterns include a coil pattern formed of a plurality of plating layers.

6 Claims, 11 Drawing Sheets

- PRIOR ART-

COIL UNIT FOR THIN FILM INDUCTOR, MANUFACTURING METHOD OF COIL UNIT FOR THIN FILM INDUCTOR, THIN FILM INDUCTOR AND MANUFACTURING METHOD OF THIN FILM INDUCTOR

CROSS REFERENCE TO RELATED APPLICATION

This application claims the benefit of and priority under 35 U.S.C. §119 to Korean Patent Application No. KR 10-2013-0096649, entitled "COIL UNIT FOR THIN FILM INDUCTOR, MANUFACTURING METHOD OF COIL UNIT FOR THIN FILM INDUCTOR, THIN FILM INDUCTOR AND MANUFACTURING METHOD OF THIN FILM INDUCTOR," filed on Aug. 14, 2014, which is hereby incorporated by reference in its entirety into this application.

BACKGROUND

Field of the Invention

The invention relates to a coil unit for a thin film inductor, a manufacturing method of a coil unit for a thin film inductor, a thin film inductor, and a manufacturing method of a thin film inductor.

Description of the Related Art

With the recent advances in the electronic industry, electronic products including mobile phones are rapidly becoming smaller and more functional. Accordingly, components necessarily used in the electronic products are also needed to perform high functions while being light and small. Therefore, even in the development of inductors used in the electronic products, miniaturization and slimming are emerging as more important tasks.

According to this trend, there is a focus on the development of the inductor that can reconcile miniaturization and slimming characteristics as well as high functions. As the inductor like this, in recent times, a thin film inductor has been developed and put to practical use.

The current thin film inductor mainly employs a coil unit in which coil patterns are formed on the top and bottom of an insulating substrate as shown, for example, in FIG. 1 of Korean Patent Publication No. 1999-0066108.

However, in the coil unit for a thin film inductor having the above structure, the entire thickness of the coil unit is increased since the coil patterns are formed on the top and bottom of the insulating substrate, and there are difficulties in designing the characteristics of the thin film inductor due to the variations in plating thickness and the application of insulating materials.

Therefore, it is needed to develop a coil unit for a thin film inductor and a thin film inductor having the same that can design the characteristics of the thin film inductor more freely as well as meet the current trend that prefers small and slim devices.

SUMMARY

Accordingly, embodiments of the invention have been made to overcome the above-described problems and it is, therefore, an object of embodiments of the invention to provide a coil unit for a thin film inductor and a manufacturing method thereof and a thin film inductor and a manufacturing method thereof that can achieve miniaturization and slimming by minimizing the overall thickness.

Further, it is another object of embodiments of the invention to provide a coil unit for a thin film inductor and a manufacturing method thereof and a thin film inductor and a manufacturing method thereof that enable mass production by simplifying manufacturing processes as well as design characteristics of a thin film inductor more freely.

In accordance with at least one embodiment of the invention, there is provided a coil unit for a thin film inductor, including an insulator having a dual insulating layer of different materials, and coil patterns respectively embedded in upper and lower surfaces of the insulator, wherein the coil patterns may include a coil pattern formed of a plurality of plating layers.

In an embodiment of the invention, the coil patterns include a first coil pattern embedded from the lower surface of the insulator, and a second coil pattern embedded from the upper surface of the insulator, wherein the second coil pattern is formed of a plurality of plating layers.

In an embodiment of the invention, the insulator includes a first insulating layer having the first coil pattern embedded therein, and a second insulating layer having the second coil pattern embedded therein.

In an embodiment of the present invention, the first insulating layer is made of a mixture of prepreg and resin, and the second insulating layer is made of resin.

In an embodiment of the present invention, the first insulating layer is made of resin, and the second insulating layer is made of a mixture of prepreg and resin.

In an embodiment of the present invention, the coil unit for a thin film inductor further includes a conductive via hole for electrically connecting the first coil pattern and the second coil pattern.

In an embodiment of the present invention, an insulating resist is formed in a portion of the first coil pattern, which is exposed from the lower surface of the insulator, and a portion of the second coil pattern, which is exposed from the upper surface of the insulator.

In accordance with another embodiment of the invention, there is provided a thin film inductor including a coil unit for a thin film inductor in the present invention, and a magnetic material bonded to at least one of upper and lower surfaces of the coil unit for a thin film inductor.

In accordance with another embodiment of the invention, there is provided a manufacturing method of a coil unit for a thin film inductor, including forming a first coil pattern on each of a pair of metal layers, which are respectively bonded to both surfaces of a base layer through adhesive layers, forming a first insulating layer to embed the first coil pattern, forming a second coil pattern and a second insulating layer to embed the second coil pattern formed of a plurality of plating layers, and separating the pair of metal layers from the base layer. According to at least one embodiment, the first insulating layer and the second insulating layer are made of different materials.

In an embodiment of the invention, the step of forming the first coil pattern includes the steps of forming a first plating resist corresponding to the first coil pattern on the metal layer and exposing a predetermined region of the metal layer, forming the first coil pattern in the exposed region of the metal layer, and removing the first plating resist. According to at least one embodiment, the step of forming the first insulating layer forms the first insulating layer on the metal layer from, which the first plating resist is removed and the first coil pattern.

In an embodiment of the invention, the step of forming the second coil pattern and the second insulating layer includes the steps of forming a first plating layer of the second coil pattern on the first insulating layer, processing a via hole in the first plating layer and the first insulating layer, forming a conductive via hole by plating the via hole, forming a second plating resist on the first plating layer and exposing a predetermined region of the first plating layer, forming a second plating layer of the second coil pattern in the exposed region of the first plating layer, exposing a predetermined region of the first insulating layer by removing the second plating resist and the first plating layer under the second plating resist, forming the second insulating layer in the exposed region of the first insulating layer and the second plating layer, exposing the second plating layer by removing the second insulating layer portion formed on the second plating layer, and forming a third plating layer of the second coil pattern in the exposed region of the second plating layer.

In an embodiment of the invention, the step of separating includes the step of removing the metal layer by etching.

In an embodiment of the invention, the manufacturing method of a coil unit for a thin film inductor further includes the step of forming an insulating resist in the portion of the first coil pattern, which is exposed from the first insulating layer, and the third plating layer of the second coil pattern, which is exposed from the second insulating layer, after the step of removing the metal layer by etching.

In an embodiment of the invention, the first insulating layer is made of a mixture of prepreg and resin, and the second insulating layer is made of resin.

In an embodiment of the present invention, the first insulating layer is made of resin, and the second insulating layer is made of a mixture of prepreg and resin.

In accordance with another embodiment of the invention, there is provided a manufacturing method of a thin film inductor, including the step of bonding a magnetic material to at least one of upper and lower surfaces of a coil unit for a thin film inductor formed according to a manufacturing method of a coil unit for a thin film inductor in accordance with at least one embodiment of the present invention.

Various objects, advantages and features of the invention will become apparent from the following description of embodiments with reference to the accompanying drawings.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

DETAILED DESCRIPTION

Figure 1:
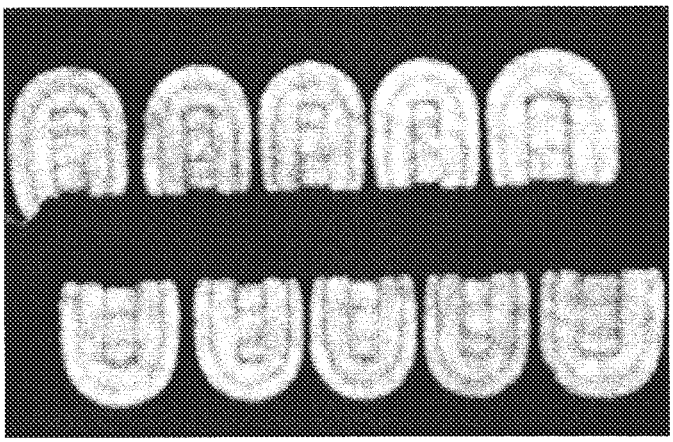
FIG. 1 is a photograph schematically showing a cross-section of a coil unit employed in a conventional thin film inductor.

Advantages and features of the invention and methods of accomplishing the same will be apparent by referring to embodiments described below in detail in connection with the accompanying drawings. However, the invention is not limited to the embodiments disclosed below and may be implemented in various different forms. The embodiments are provided only for completing the disclosure of the invention and for fully representing the scope of the invention to those skilled in the art.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the invention. Like reference numerals refer to like elements throughout the specification.

A matter regarding to an operational effect including a technical configuration for an object of a coil unit for a thin film inductor and a manufacturing method thereof and a thin film inductor and a manufacturing method thereof in accordance with embodiments of the invention will be clearly appreciated through the following detailed description with reference to the accompanying drawings showing preferable embodiments of the present invention.

Hereinafter, various embodiments of the invention will be described in detail with reference to the accompanying drawings.

Coil Unit for Thin Film Inductor

Figure 2:
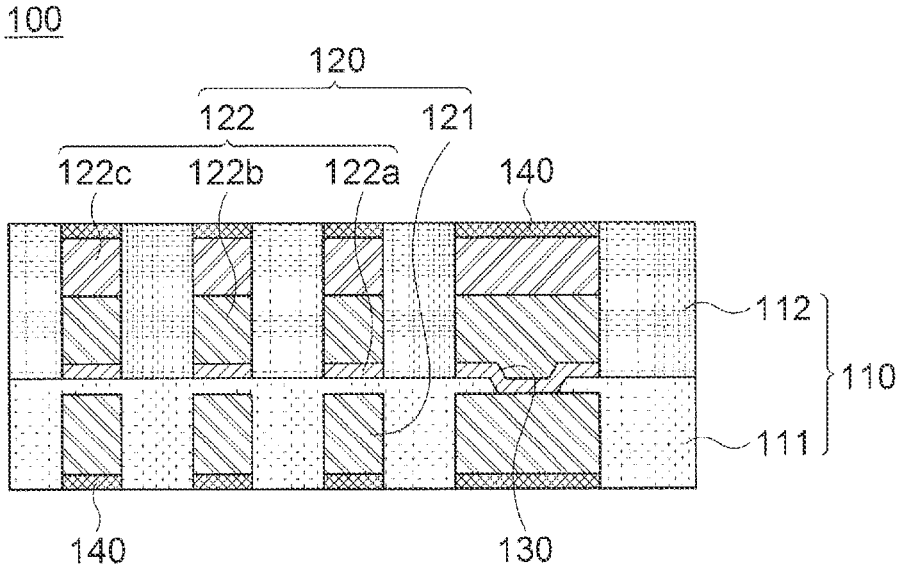
FIG. 2 is a schematic cross-sectional view of a coil unit for a thin film inductor in accordance with an embodiment of the invention.

FIG. 2 is a cross-sectional view of a coil unit 100 for a thin film inductor in accordance with an embodiment of the invention.

As shown in FIG. 2, the coil unit 100 for a thin film inductor according to an embodiment of the invention includes an insulator 110 and a coil pattern 120.

According to an embodiment, the insulator 110 has a dual insulating layer of different materials and includes a first insulating layer 111 and a second insulating layer 112, as shown in FIG. 2.

According to an embodiment, the first insulating layer 111 is formed of a mixture of prepreg (PPG) and resin, and as shown in FIG. 2, has a first coil pattern 121, which is formed from a lower surface of the insulator 110.

Further, according to an embodiment, the second insulating layer 112 is formed of a resin type, and as shown in FIG. 2, has a second coil pattern 122, which is formed from an upper surface of the insulator 110.

At least one embodiment considers the case in which the first insulating layer 111 is formed of a mixture of PPG and resin and the second insulating layer 112 is formed of a resin type, but embodiments of the invention are not limited thereto, and therefore embodiments of the invention allow for any case if the first insulating layer 111 and the second insulating layer 112 are made of different materials.

Therefore, according to an embodiment, the first insulating layer 111 is formed of a resin type, and the second insulating layer 112 is formed of a mixture of PPG and resin. In addition, various embodiments or applications, such as forming the first and second insulating layers 111 and 112 with different materials while forming the first and second insulating layers 111 and 112 with at least one material or a mixture of at least two materials selected from acrylic polymers, phenolic polymers, and polyimide polymers, are allowed.

As noted above, embodiments of the invention can freely adjust the thickness of the insulator 110 compared to a structure having a single insulating layer by forming the insulator 110 having a structure of the dual insulating layer 111 and 112 of different materials.

Therefore, the above structure according to various embodiments of the invention have an advantage that can design the capacitance characteristics of a thin film inductor more freely by freely adjusting the thickness of the insulator embedding upper and lower coils and thus freely adjusting the insulation distance between the coil pattern and a magnetic material described below.

Further, embodiments of the invention can improve the degree of freedom in designing the characteristics of the thin film inductor, such as capacitance, by designing the interval (length) between the coils freely through the free adjustment of the thickness of the insulator embedding the upper and lower coils, because the capacitance is proportional to permittivity and inversely proportional to the interval between coils.

Next, as shown in FIG. 2, the coil patterns 120, according to an embodiment of the invention, are embedded in the upper and lower surfaces of the insulator 110, respectively.

As further noted above, embodiments of the invention can minimize the entire thickness of the coil unit compared to a coil unit having coil patterns formed on upper and lower surfaces of an insulator by embedding the coil patterns 120 in the upper and lower surfaces of the insulator 110, thus achieving the miniaturization and slimming of the thin film inductor having the coil unit.

Further, according to embodiment of the invention, coil patterns 120 include the coil pattern 122 formed of a plurality of plating layers. In at least one embodiment, as shown in FIG. 2, the second coil pattern 122 embedded in the upper surface of the insulator 110 is formed of a plurality of plating layers, but embodiments of the invention are not limited thereto, and the first coil pattern 121 embedded in the lower surface of the insulator 110 also can be formed of a plurality of plating layers.

In forming the coil for a thin film inductor, as above, embodiments of the invention can adjust the cross-sectional area of the upper and lower coil patterns differently through a plurality of layers of plating by including the coil pattern 122 formed of a plurality of plating layers, thus improving the degree of freedom in designing the characteristics of the thin film inductor such as impedance.

Further, according to at least one embodiment, coil patterns 120, as shown in FIG. 2, include the first coil pattern 121 and the second coil pattern 122.

According to an embodiment, the first coil pattern 121, as shown in FIG. 2, is embedded from the lower surface of the insulator 110 and embedded in the first insulating layer 111 of the insulator 110.

According to an embodiment, the second coil pattern 122, as shown in FIG. 2, is embedded from the upper surface of the insulator 110 and embedded in the second insulating layer 112 of the insulator 110.

According to an embodiment, the first coil pattern 121 and the second coil pattern 122 are made of at least one material or a mixture of at least two materials selected from copper (Cu), gold (Au), silver (Ag), aluminum (Al), and nickel (Ni), but embodiments of the invention are not limited thereto.

According to an embodiment, the coil unit 100 for a thin film inductor, as shown in FIG. 2, further includes a conductive via hole 130 for electrically connecting the first coil pattern 121 and the second coil pattern 122.

According to an embodiment, the conductive via hole 130 is formed by processing a via hole in the insulator 110 through a mechanical method or a laser or photolithography process and plating the via hole through a process such as desmear or chemical copper.

In addition, in the coil unit 100 for a thin film inductor according to at least one embodiment, as shown in FIG. 2, a solder resist 140 is formed in the portion exposed from the lower surface of the insulator 110 in the first coil pattern 121 and the portion exposed from the upper surface of the insulator 110 in the second coil pattern 122. However, embodiments of the invention are not limited to the above and allows any resist if it is an insulating resist that can protect the exposed portion of the coil pattern.

Manufacturing Method of Coil Unit for Thin Film Inductor

Figure 3:
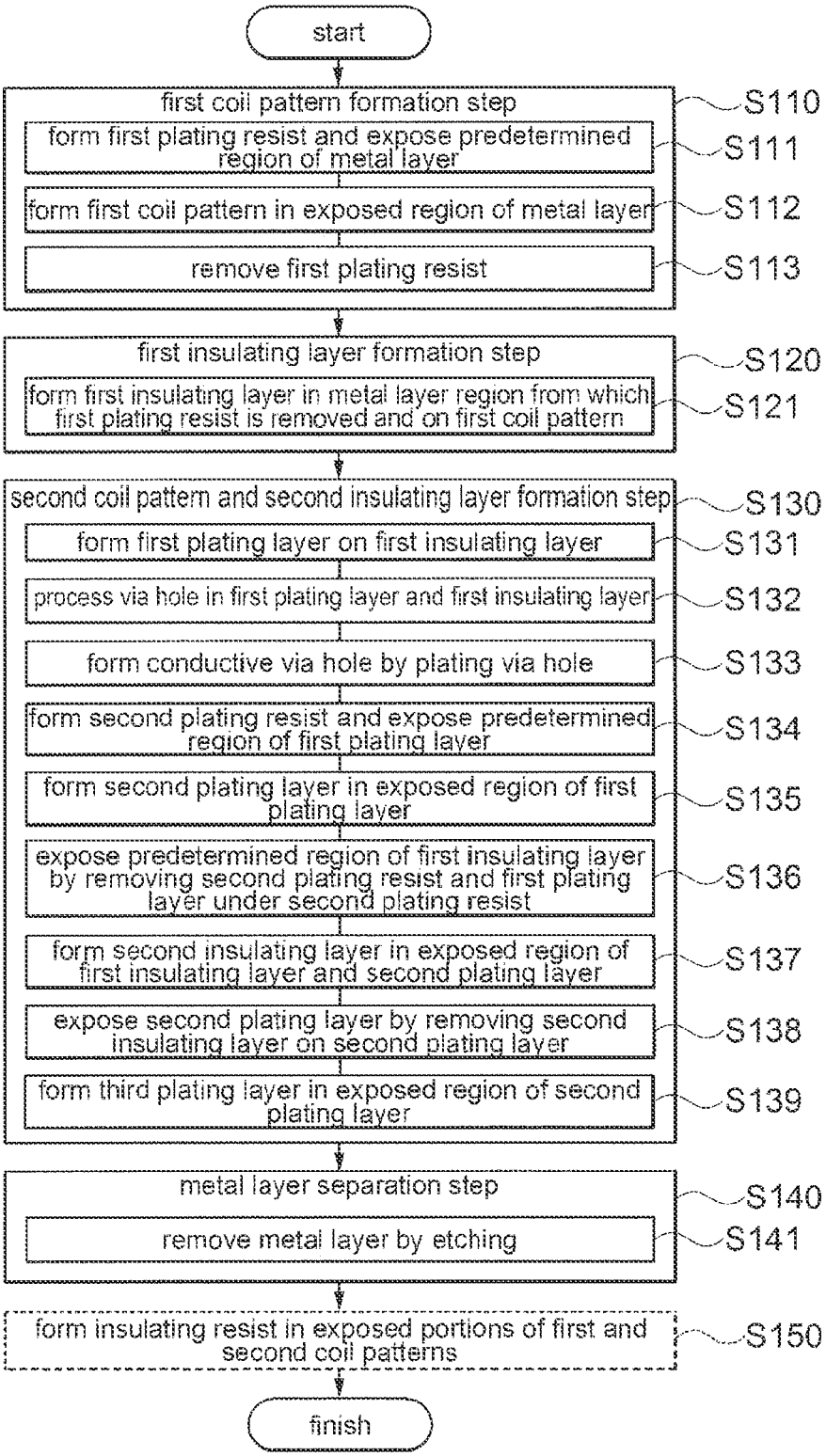
FIG. 3 is a flowchart for explaining a manufacturing method of a coil unit for a thin film inductor in accordance with an embodiment of the invention.

FIG. 3 is a flowchart for explaining a manufacturing method of a coil unit for a thin film inductor in accordance with an embodiment of the invention.

Referring to FIG. 3, the manufacturing method of a coil unit for a thin film inductor in accordance with an embodiment of the invention includes the steps of forming a first coil pattern on each of a pair of metal layers, which are respectively bonded to both surfaces of a base layer through adhesive layers (S110), forming a first insulating layer to embed the first coil pattern (S120), forming a second coil pattern and a second insulating layer to embed the second coil pattern formed of a plurality of plating layers (S130), and separating the pair of metal layers from the base layer (S140). According to an embodiment, the first and second insulating layers formed at this time are made of different materials.

Figure 4:
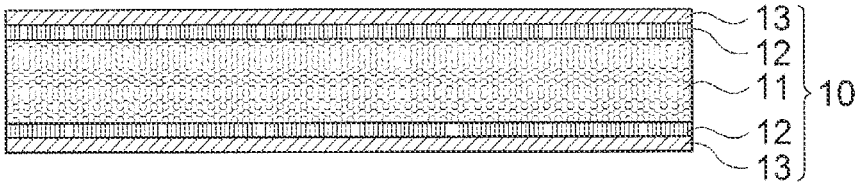
FIG. 4 is a schematic cross-sectional view of a carrier used in the manufacturing method of a coil unit for a thin film inductor in accordance with an embodiment of the invention.

Embodiments of the invention may employ a manufacturing method using a carrier shown in FIG. 4. FIG. 4 is a schematic cross-sectional view of the carrier used in the manufacturing method of a coil unit for a thin film inductor in accordance with an embodiment of the invention.

As shown in FIG. 4, the manufacturing method of a coil unit for a thin film inductor according to an embodiment uses a carrier 10 in which a pair of metal layers 13 are bonded to both surfaces of a base layer 11 through adhesive layers 12, respectively.

According to an embodiment, the carrier 10, as shown in FIG. 4, includes the base layer 11, the pair of adhesive layers 12, which are laminated on the both surfaces of the base layer 11, respectively, and the pair of metal layers 13, which are bonded to the pair of adhesive layers 12, respectively.

According to an embodiment, the base layer 11 individually separates the metal layers 13, which are respectively bonded to the adhesive layers 12 by dividing the adhesive layers 12 formed on the both surfaces of the base layer 11. As the base layer 11, paper, nonwoven fabric, and synthetic resins, such as polyethylene, polypropylene, and polybutylene may be used.

According to an embodiment, the adhesive layers 12 are laminated on the both surfaces of the base layer 11, respectively. According to an embodiment, the adhesive strength of the adhesive layer 12 is deteriorated by a predetermined factor, and the predetermined factors are ultraviolet rays or heat.

According to an embodiment, the metal layer 13 bonded to the adhesive layer 12 is bonded to the adhesive layer 12 and then easily separated from the base layer 11 when the adhesive strength of the adhesive layer 12 is deteriorated by the predetermined factor.

According to an embodiment, the properties of the adhesive that forms the adhesive layer 12 are changed by the predetermined factor to cause the deterioration of the adhesive strength so that the metal layer 13 can be easily separated from the base layer 11. For example, if the adhesive layer 12 is formed using an adhesive mixed with a material from which gas is generated by the irradiation of ultraviolet rays, the volume of the adhesive layer 12 is changed by the gas generated in the adhesive layer 12 at the time of the irradiation of the ultraviolet rays when separating the metal layer 13, thus deteriorating the adhesive strength of the adhesive layer 12.

Further, according to an embodiment, the if the adhesive layer 12 is formed using a foaming adhesive mixed with a material which is foamed by the heat of a predetermined temperature, foaming is generated in the adhesive layer 12 by the predetermined temperature when separating the metal layer 13, thereby making an adhesive surface uneven and thus deteriorating the adhesive strength of the adhesive layer 12.

According to an embodiment, the metal layer 13 is bonded to the base layer 11 by the adhesive layer 12 and then separated from the base layer 11 when necessary. For example, according to the manufacturing method of an embodiment of the invention, it is possible to manufacture two coil units for a thin film inductor having circuit patterns embedded in upper and lower surfaces of an insulator 110 at a time by forming an embossed first coil pattern 121 on the metal layer 13, embedding the embossed circuit pattern 121 through a first insulating layer 111, forming a second coil pattern 122 and a second insulating layer 112 having the second coil pattern 122 embedded therein on the first insulating layer 111, and separating the metal layer 13 from the base layer 11.

As noted above, embodiments of the invention can manufacture the two coil units for a thin film inductor through one process by employing a process of using the carrier 10, more particularly a process of respectively forming the circuit patterns on the pair of metal layers 13 of the carrier 10 and separating the metal layers 13 having the circuit patterns thereon, thus enabling mass-production by simplifying manufacturing processes.

Meanwhile, according to an embodiment, the separation of the metal layer 13 from the base layer 11 is performed by deteriorating the adhesive strength of the adhesive layer 12 interposed between the base layer 11 and the metal layer 13. According to an embodiment, the metal layer 13 is separated from the base layer 11 when the adhesive strength of the adhesive layer 12 is deteriorated by applying the predetermined factor to the adhesive.

According to an embodiment, the metal layer 13 is made of a conductive metal. In this case, the conductive metal is at least one selected from the group consisting of copper (Cu), gold (Au), silver (Ag), nickel (Ni), palladium (Pd), and platinum (Pt), but embodiments of the invention are not limited thereto and allows various applications, such as forming the metal layer 13 using one of the above metals or forming the metal layer 13 by mixing the above metals.

FIGS. 5A-5C, 6A-6H, and 7A-7C are process diagrams showing the manufacturing method of a coil unit for a thin film inductor in accordance with an embodiment of the invention, and each step of the above manufacturing method will be described in detail through the process diagram.

Figure 5A:
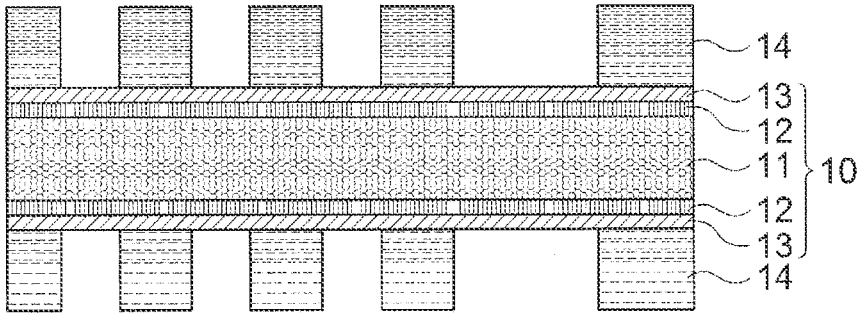
FIGS. 5A-5C are process diagrams showing a first coil pattern formation step and a first insulating layer formation step of FIG. 3, in accordance with an embodiment of the invention.
Figure 5B:
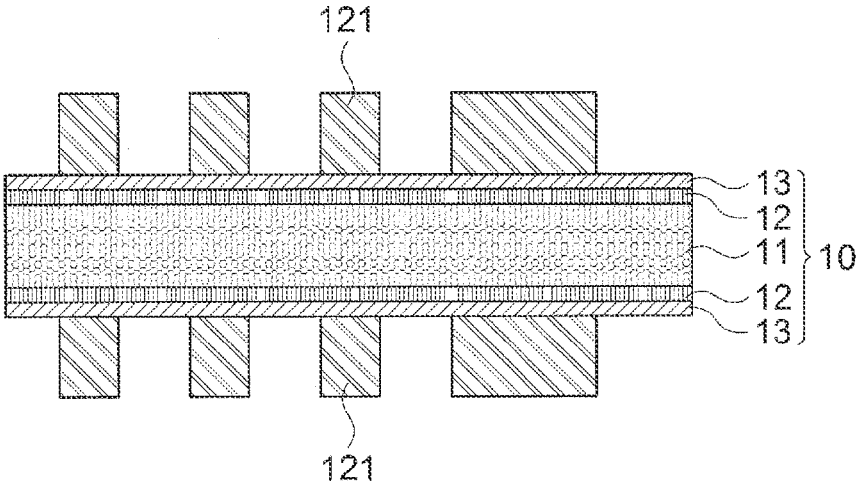
Figure 5C:
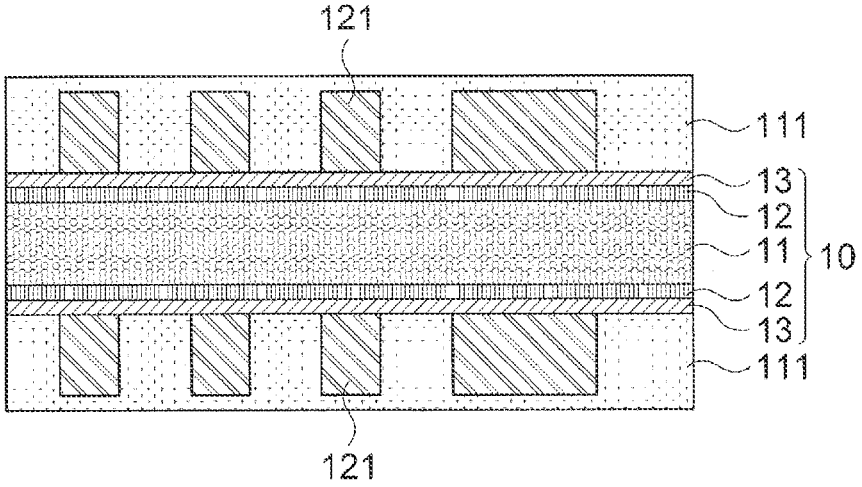

According to an embodiment, FIGS. 5A-5C are process diagrams showing the steps S110 and S120 of FIG. 3, i.e., the first coil pattern formation step and the first insulating layer formation step.

As shown in FIGS. 3 and 5A-5C, the first coil pattern formation step S110 according to an embodiment of the invention includes the steps of forming a first plating resist corresponding to the first coil pattern on the metal layer and exposing a predetermined region of the metal layer (S111), forming the first coil pattern on the metal layer region exposed in the step S111 (S112), and removing the first plating resist formed in the step S111 (S113).

According to an embodiment, the first insulating layer formation step S120, as shown in FIGS. 3 and 5A-5C, includes the step of forming the first insulating layer on the metal layer, from which the first plating resist is removed, and the first coil pattern (S121).

The first coil pattern formation step S110 according to an embodiment of the invention will be described in detail. First, as shown in FIG. 5A, the predetermined region (first coil pattern region) of the metal layer 13 is exposed by forming a first plating resist 14 corresponding to the first coil pattern on each of the pair of metal layers 13 of the carrier 10 (S111).

According to an embodiment, a dry film resist (DFR) is used as the first plating resist 14, but embodiments of the invention are not limited thereto and allows any type of resist pattern, such as a photo resist if it is to form the coil pattern.

As shown in FIG. 5B, the first coil pattern 121 is formed by performing electroplating using the metal layer 13 as an electrode to fill the region (metal layer region in which the first plating resist 14 is not formed) exposed in the step S111 in each of the pair of metal layers 13 with a conductive material (S112), and the first coil pattern 121 is formed on each of the pair of metal layers 13 by removing the first plating resist 14 through processes such as exposure and development.

Further, the first insulating layer formation step S120 according to embodiments of the invention will be described in detail. As shown in FIG. 5C, the first coil pattern 121 is embedded in the first insulating layer 111 by interposing the first insulating layer 111 on the metal layer 13 region from which the first plating resist 14 is removed and the first coil pattern 121 formed in the step S110.

FIGS. 6A-6H are process diagrams showing the step S130 of FIG. 3, i.e., the second coil pattern and second insulating layer formation step.

As shown in FIGS. 3 and 6A-6H, the second coil pattern and second insulating layer formation step S130 according to embodiments of the invention include the steps of forming a first plating layer of the second coil pattern on the first insulating layer formed in the step S120 (S131), processing a via hole in the first plating layer and the first insulating layer (S132), forming a conductive via hole by plating the via hole processed in the step S132 (S133), forming a second plating resist on the first plating layer formed in the step S131 and exposing a predetermined region of the first plating layer (S134), forming a second plating layer of the second coil pattern in the first plating layer region exposed in the step S134 (S135), exposing a predetermined region of the first insulating layer by removing the second plating resist and the first plating layer under the second plating resist (S136), forming the second insulating layer on the first insulating layer region exposed in the step S136 and the second plating layer formed in the step S135 (S137), exposing the second plating layer by removing the second insulating layer region formed on the second plating layer (S138), and forming a third plating layer of the second coil pattern in the second plating layer region exposed in the step S138 (S139).

Figure 6A:
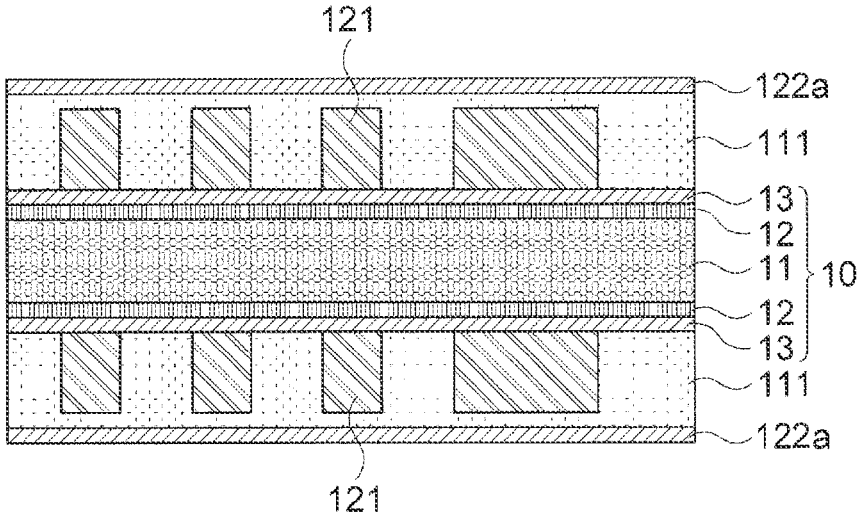
FIGS. 6A-6H are process diagrams showing a second coil pattern and second insulating layer formation step of FIG. 3, in accordance with an embodiment of the invention.

The second coil pattern and second insulating layer formation step S130 according to embodiments of the invention will be described in detail. First, as shown in FIG. 6A, a first plating layer 122*a* is formed on the first insulating layer 111 formed in the step S120 (S131).

Figure 6B:
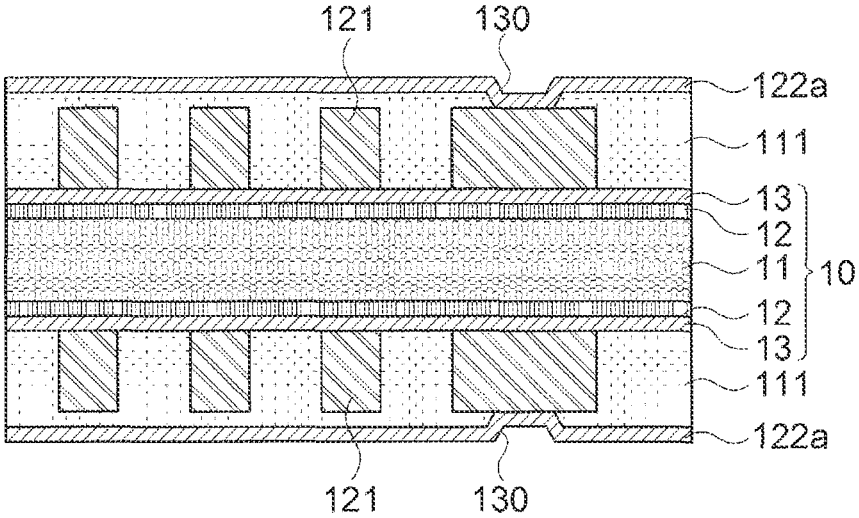

As shown in FIG. 6B, a via hole is processed in the first plating layer 122*a* and the first insulating layer 111 (S132), and a conductive via hole 130 is formed by plating the via hole processed in the step S132 through processes such as desmear and chemical copper (S133). According to an embodiment, the via hole h is processed by a mechanical method or a laser or photolithography process, but embodiments of the invention are not limited thereto.

Figure 6C:
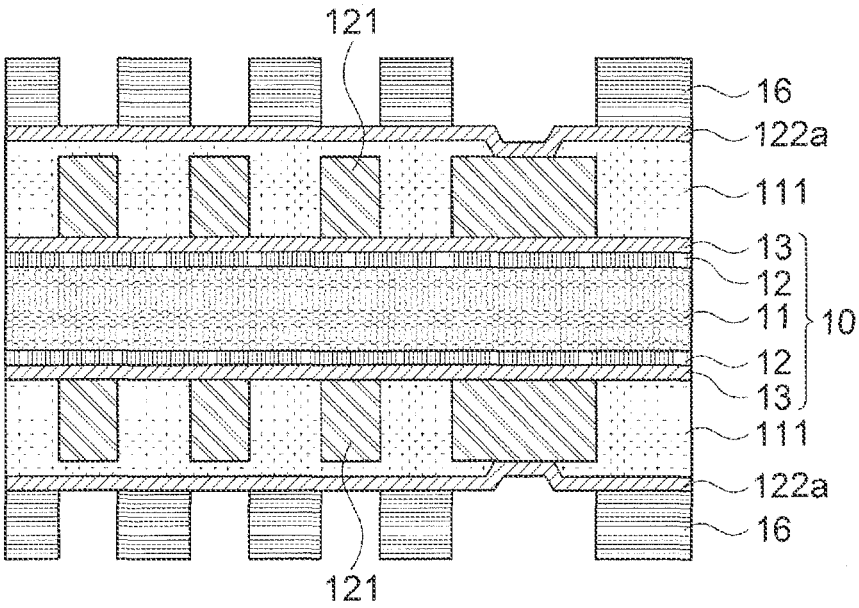

As shown in FIG. 6C, a predetermined region of the first plating layer 122*a* is exposed by forming a second plating resist 16 on the first plating layer 122*a* formed in the step S131 (S134).

According to an embodiment, as the second plating resist 16, like the first plating resist 14 in the step S111, the DFR is used, but embodiments of the invention are not limited thereto, and allows any type of resist pattern such as photo resist if it is to form a second plating layer 122*b* described below.

Figure 6D:
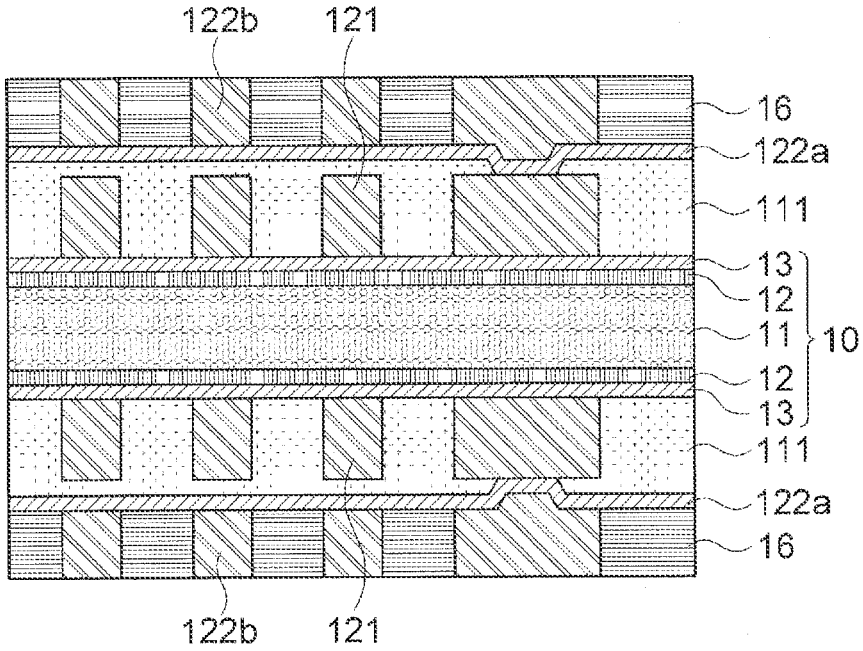

As shown in FIG. 6D, the second plating layer 122*b* of the second coil pattern 122 are formed by performing electroplating using the first plating layer 122*a* as an electrode to fill the region (first plating layer region in which the second plating resist 16 is not formed) exposed in the step S134 in each of the first plating layers 122*a* with a conductive material (S135).

Figure 6E:
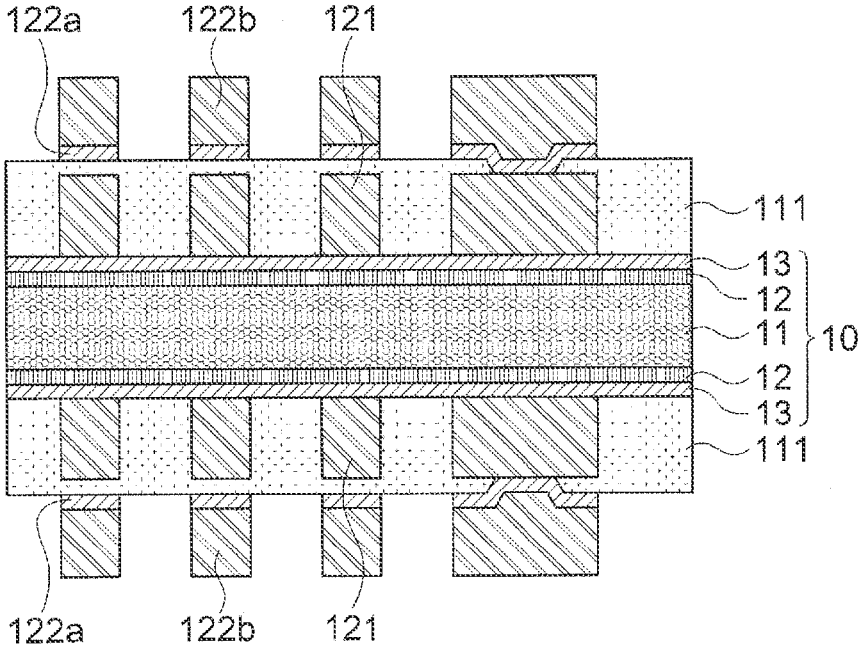

As shown in FIG. 6E, a predetermined region of the first insulating layer 111 is exposed by removing the first plating layer 122*a* under the second plating resist 16 through a process such as etching while removing the second plating resist 16 through processes, such as exposure and development (S136).

Figure 6F:
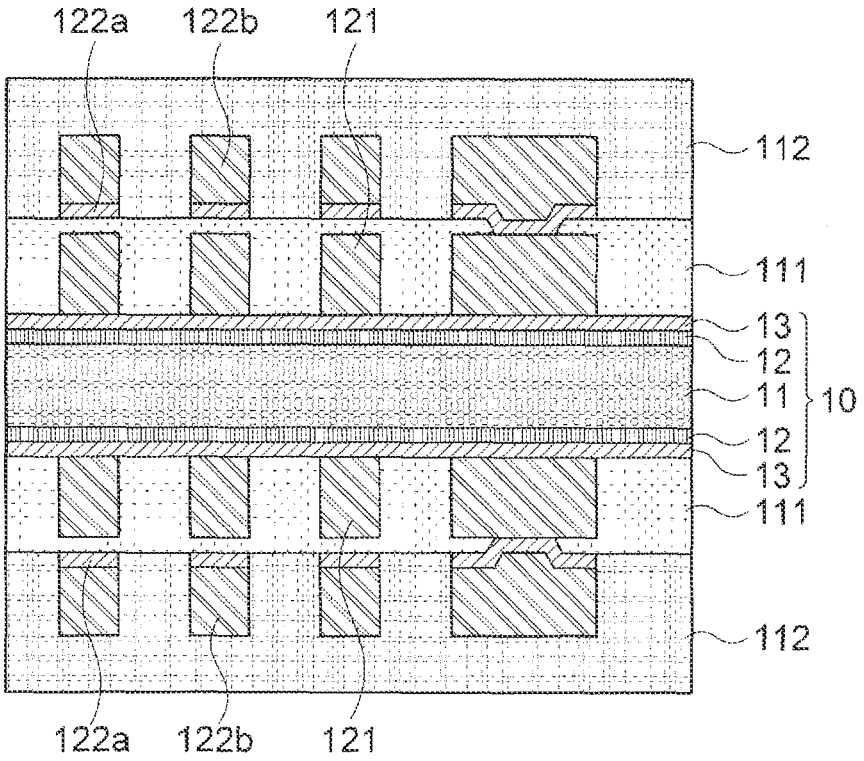

As shown in FIG. 6F, the second insulating layer 112 is interposed on the first insulating layer 111 region exposed in the step S136 and the second plating layer 122*b* formed in the step S135 (S137).

Figure 6G:
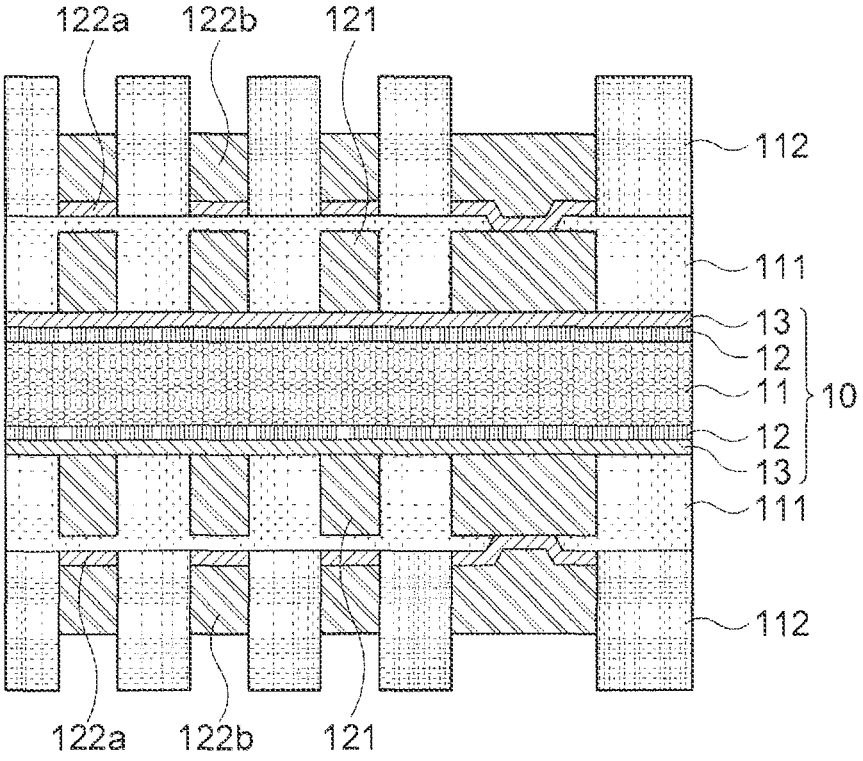

As shown in FIG. 6G, the second plating layer 122*b* is exposed by removing the second insulating layer 112 portion formed on the second plating layer 122*b* through processes such as exposure and development.

Figure 6H:
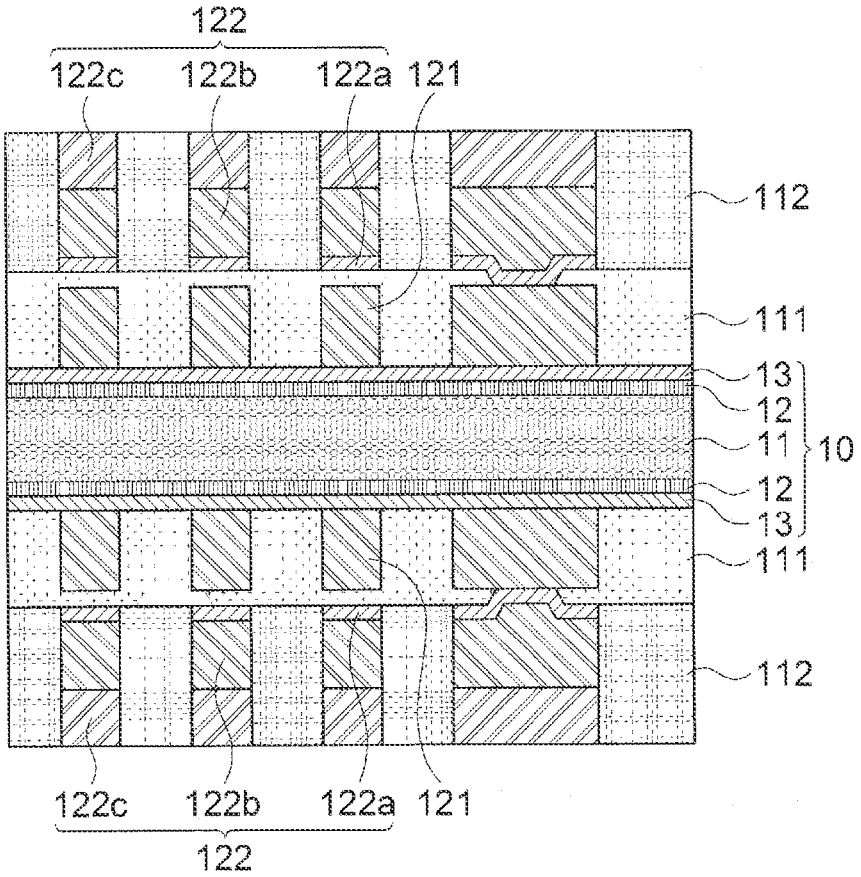

As shown in FIG. 6H, a third plating layer 122*c* is formed by performing electroplating using the second plating layer 122*b* as an electrode to fill the second plating layer region (second plating layer region from which the second insulating layer portion is removed) exposed in the step S138 with a conductive material (S139). Accordingly, the second coil pattern 122 is formed of a plurality of plating layers of the first to third plating layers 122*a*, 122*b*, and 122*c*.

Meanwhile, according to embodiments of the manufacturing method of a coil unit for a thin film inductor, the first insulating layer 111 formed in FIGS. 5A-5C is formed of a mixture of PPG and resin, and the second insulating layer 112 formed in FIGS. 6A-6H is formed of a resin type. However, embodiments of the invention are not limited to the above, and allows any case if the first insulating layer 111 and the second insulating layer 112 are made of different materials.

Therefore, the first insulating layer 111 is formed of a resin type, and the second insulating layer 112 is formed of a mixture of PPG and resin. In addition, various embodiments and applications, such as forming the first and second insulating layers 111 and 112 with different materials while forming the first and second insulating layers 111 and 112 with at least one material or a mixture of at least two materials selected from acrylic polymers, phenolic polymers, and polyimide polymers, are allowed.

According to the above manufacturing method of various embodiments of the invention, it is possible to form the insulator having a structure of the dual insulating layer 111 and 112 of different materials, thus freely adjusting the thickness of the insulator compared to a structure having a single insulating layer.

Therefore, according to the above manufacturing method of various embodiments of the invention, it is possible to design the capacitance characteristics of the thin film inductor more freely by freely adjusting the thickness of the insulator embedding upper and lower coils and thus freely adjusting the insulation distance between the coil pattern and a magnetic material described below.

Further, according to the above manufacturing method of various embodiments of the invention, it is possible to improve the degree of freedom in designing the characteristics of the thin film inductor, such as capacitance, by designing the interval (length) between coils more freely through the free adjustment of the thickness of the insulator embedding the upper and lower coils. As also described above, this is because the capacitance is proportional to permittivity and inversely proportional to the interval between coils.

In addition, according to the above manufacturing method of various embodiments of the invention, it is possible to minimize the entire thickness of the coil unit compared to a coil unit having coil patterns formed on upper and lower surfaces of an insulator by embedding the coil patterns 121 and 122 in the upper and lower surfaces of the insulator 110, thus achieving the miniaturization and slimming of the thin film inductor having the coil unit.

Further, according to the above manufacturing method of various embodiments of the invention, in forming the coil for a thin film inductor, it is possible to differently adjust the cross-sectional area of the upper and lower coil patterns through a plurality of layers of plating by including the coil pattern 122 formed of a plurality of plating layers, thus improving the degree of freedom in designing the characteristics of the thin film inductor such as impedance.

Figure 7A:
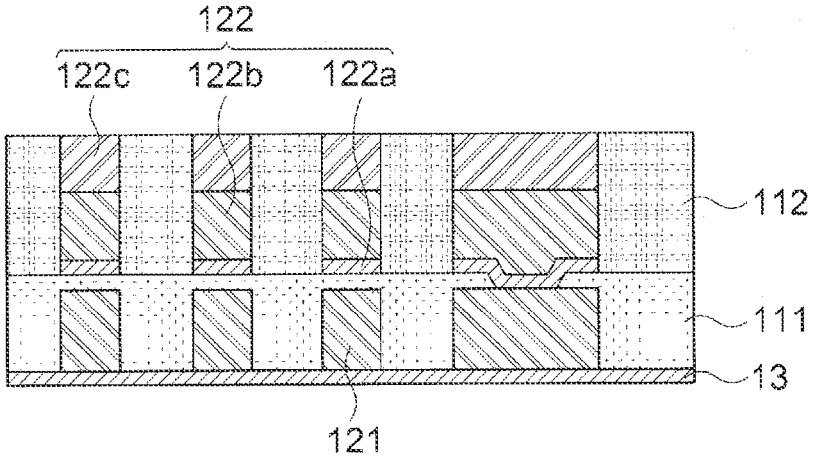
FIGS. 7A-7C are process diagrams showing a metal layer separation step and an insulating resist formation step of FIG. 3, in accordance with an embodiment of the invention.
Figure 7B:
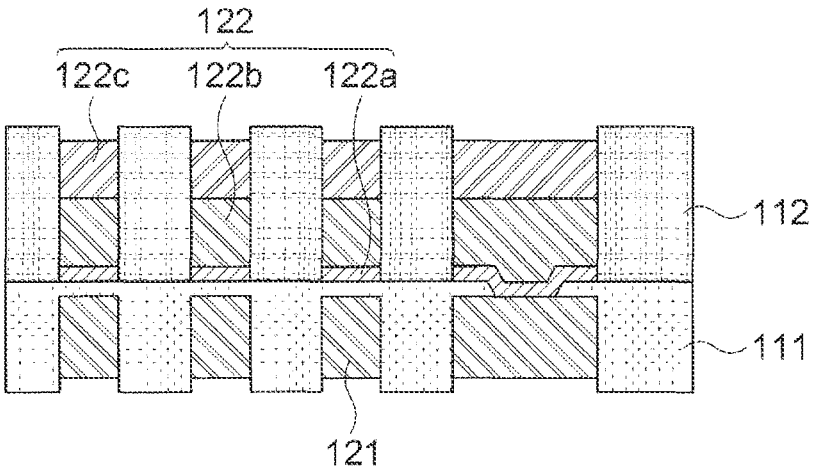
Figure 7C:
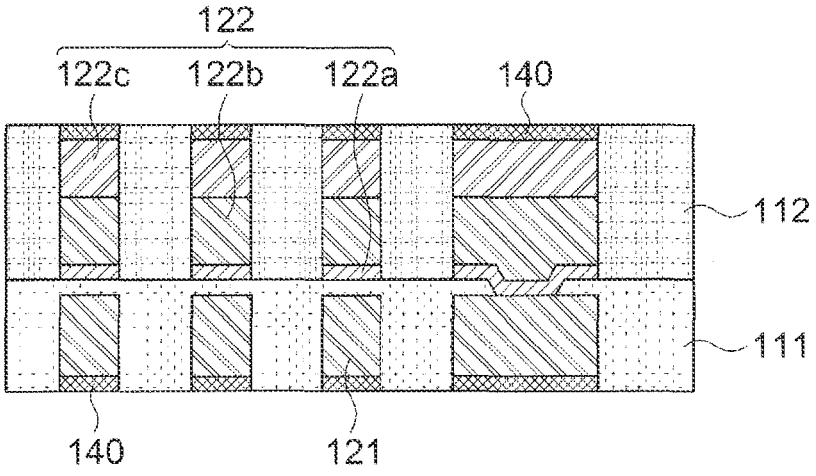

FIGS. 7A-7C are process diagrams showing the steps S140 and S150 of FIG. 3, i.e., the metal layer separation step and the insulating resist formation step.

First, the metal layer separation step S140 according to embodiments of the invention, as shown in FIGS. 3 and 7, separates the pair of metal layers from the base layer.

As shown in FIG. 7A, in the metal layer separation step S140 according to embodiments of the invention, the pair of metal layers 13 are separated from the base layer 11. Accordingly, since it is possible to manufacture the two coil units for a thin film inductor through one process, it is possible to perform mass-production by simplifying manufacturing processes of the coil unit.

Further, in the metal layer separation step S140 according to embodiments of the invention, as also described above, since the adhesive layers 12, whose adhesive strength is deteriorated by the predetermined factor, are laminated on the both surfaces of the base layer 11 and the metal layers 13 are respectively bonded to the adhesive layers 12, the metal layers 13 are separated after applying the predetermined factor to the adhesive layers 12 to deteriorate the adhesive strength of the adhesive layers 12.

According to an embodiment, the predetermined factor that deteriorates the adhesive strength of the adhesive layer 12 is ultraviolet rays or heat. According to at least one embodiment, if the adhesive layer 12 is formed using an adhesive mixed with a material from which gas is generated by the irradiation of ultraviolet rays, the volume of the adhesive layer 12 is changed by the gas generated in the adhesive layer 12 at the time of the irradiation of the ultraviolet rays when separating the metal layer 13 and thus the adhesive strength of the adhesive layer 12 is deteriorated. Further, according to an embodiment, if the adhesive layer 12 is formed using a foaming adhesive mixed with a material which is foamed by the heat of a predetermined temperature, foaming is generated in the adhesive layer 12 by the predetermined temperature when separating the metal layer 13, thereby making an adhesive surface uneven and thus deteriorating the adhesive strength of the adhesive layer 12.

The metal layer separation step S140 according to embodiments of the invention, as shown in FIGS. 3 and 7A-7C, include the step of removing the metal layer by etching (S141).

As shown in FIG. 7B, in the metal layer separation step S140 according to embodiments of the invention, the pair of metal layers 13 separated from the base layer 11 are removed by etching.

Next, the manufacturing method of a coil unit for a thin film inductor according to various embodiments of the invention, as shown in FIGS. 3 and 7A-7C, further includes the step of forming an insulating resist in the portion exposed from the first insulating layer in the first coil pattern and the third plating layer exposed from the second insulating layer in the second coil pattern (S150).

As shown in FIG. 7C, a solder resist 140 is formed in the portion of the first coil pattern 121, which is exposed from the first insulating layer 111, and the third plating layer 122*c* of the second coil pattern 122, which is exposed from the second insulating layer 112. However, embodiments of the invention are not limited to the above, and allows any resist if it an insulating resist that can protect the exposed portion of the coil pattern.

Thin Film Inductor and Manufacturing Method Thereof

Figure 8:
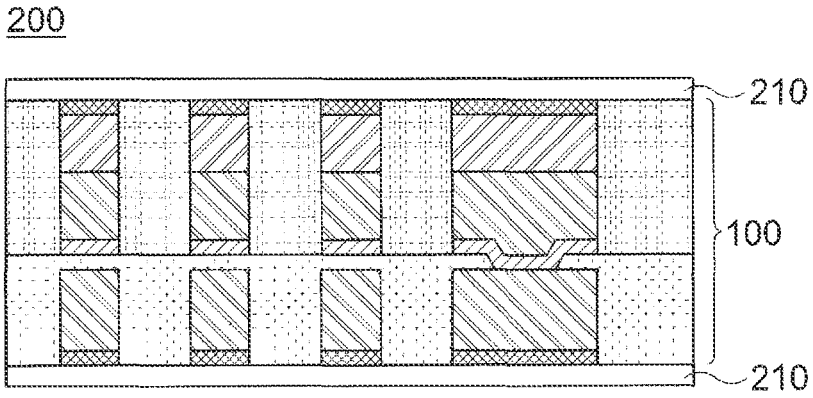
FIG. 8 is a schematic cross-sectional view of a thin film inductor in accordance with an embodiment of the invention.

FIG. 8 is a schematic cross-sectional view of a thin film inductor 200 in accordance with an embodiment of the invention.

Referring to FIG. 8, the thin film inductor 200 according to embodiments of the invention, as shown in FIG. 2, includes a magnetic material 210 bonded to a coil unit 100 for a thin film inductor.

Embodiments of the invention include the case in which the magnetic material 210 is bonded to both of upper and lower surfaces of the coil unit 100 for a thin film inductor, but embodiments of the invention are not limited thereto and may form the thin film inductor 200 by bonding the magnetic material 210 only to the upper or lower surface of the coil unit 100 for a thin film inductor.

According to an embodiment, when bonding the magnetic material 210 to the coil unit 100 for a thin film inductor, the magnetic material 210 is bonded using polymers such as epoxy and polyimide or other adhesives.

Further, according to an embodiment, as the magnetic material 210, conventional ferrite powder is used as it is, and ferrite formed on glass or other substrates is used as the magnetic material. In addition, a laminated film of soft magnetic films or insulating films formed by a thin film manufacturing process are used.

Meanwhile, the thin film inductor 200, as shown in FIG. 8, is formed by including the step of bonding the magnetic material 210 to at least one of the upper and lower surfaces of the coil unit 100 for a thin film inductor after forming the coil unit 100 for a thin film inductor formed according to the manufacturing method shown in FIGS. 3 to 7A-7C, i.e., the coil unit 100 for a thin film inductor shown in FIG. 2.

According to the coil unit for a thin film inductor and the manufacturing method thereof and the thin film inductor and the manufacturing method thereof in accordance with embodiments of the invention described above, it is possible to minimize the entire thickness of the coil unit for a thin film inductor by embedding the coil patterns in the upper and lower surfaces of the insulator 110, thus achieving the miniaturization and slimming of the thin film inductor having the coil unit.

Further, according to the coil unit for a thin film inductor and the manufacturing method thereof and the thin film inductor and the manufacturing method thereof in accordance with embodiments of the invention, it is possible to freely adjust the thickness of the insulator than an insulator having a single structure by forming the insulator having a dual structure of different materials, thus designing the characteristics of the thin film inductor such as capacitance more freely.

Further, according to the coil unit for a thin film inductor and the manufacturing method thereof and the thin film inductor and the manufacturing method thereof in accordance with embodiments of the invention, it is possible to adjust the cross-sectional area of the coil pattern through a plurality of layers of plating by including the coil pattern formed of a plurality of plating layers, thus designing the characteristics of the thin film inductor such as impedance more freely.

In addition, according to the coil unit for a thin film inductor and the manufacturing method thereof and the thin film inductor and the manufacturing method thereof in accordance with embodiments of the invention, it is possible to manufacture the two coil units for a thin film inductor through one process by employing the process of forming the circuit pattern on each of the pair of metal layers, which are respectively bonded to the both surfaces of the base layer through the adhesive layers, and separating the metal layers, thus enabling mass-production by simplifying manufacturing processes.

Terms used herein are provided to explain embodiments, not limiting the invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Embodiments of the invention may suitably comprise, consist or consist essentially of the elements disclosed and may be practiced in the absence of an element not disclosed. For example, it can be recognized by those skilled in the art that certain steps can be combined into a single step.

The terms and words used in the specification and claims should not be interpreted as being limited to typical meanings or dictionary definitions, but should be interpreted as having meanings and concepts relevant to the technical scope of the invention based on the rule according to which an inventor can appropriately define the concept of the term to describe the best method he or she knows for carrying out the invention.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

As used herein, the terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical or non-electrical manner. Objects described herein as being "adjacent to" each other may be in physical contact with each other, in close proximity to each other, or in the same general region or area as each other, as appropriate for the context in which the phrase is used. Occurrences of the phrase "according to an embodiment" herein do not necessarily all refer to the same embodiment.

Ranges may be expressed herein as from about one particular value, and/or to about another particular value. When such a range is expressed, it is to be understood that another embodiment is from the one particular value and/or to the other particular value, along with all combinations within said range.

Although the invention has been described in detail, it should be understood that various changes, substitutions, and alterations can be made hereupon without departing from the principle and scope of the invention. Accordingly, the scope of the invention should be determined by the following claims and their appropriate legal equivalents.

What is claimed is:

1. A coil unit for a thin film inductor, comprising:

a first insulating layer;

a second insulating layer disposed on the first insulating layer;

a first coil pattern embedded in the first insulating layer; and a second coil pattern embedded in the second insulating layer, wherein a number of plating layers forming the first coil pattern is different from a number of plating layers forming the second coil pattern, and at least one of the first and second coil patterns is formed of three or more plating layers.

2. The coil unit for the thin film inductor according to claim 1, wherein the first insulating layer is made of a mixture of prepreg and resin, and the second insulating layer is made of resin.

3. The coil unit for the thin film inductor according to claim 1, wherein the first insulating layer is made of resin, and the second insulating layer is made of a mixture of prepreg and resin.

4. The coil unit for the thin film inductor according to claim 1, further comprising:

a conductive via hole for electrically connecting the first coil pattern and the second coil pattern.

5. The coil unit for the thin film inductor according to claim 1, wherein an insulating resist is formed in a portion of the first coil pattern, which is exposed from the lower surface of the first insulating layer, and a portion of the second coil pattern, which is exposed from the upper surface of the second insulating layer.

6. A thin film inductor, comprising:

a coil unit for a thin film inductor according to claim 1; and a magnetic material bonded to at least one of the upper and lower surfaces of the coil unit for the thin film inductor.

* * * * *